US010920178B2

(12) United States Patent
Blondeau et al.

(10) Patent No.: US 10,920,178 B2
(45) Date of Patent: Feb. 16, 2021

(54) DISHWASHER DETERGENT FRAGRANCE COMPOSITION

(71) Applicant: GIVAUDAN SA, Vernier (CH)

(72) Inventors: Philippe Blondeau, Paris (FR); Alice Bresson Boil, Herblay (FR); Maxence Moutte, Paris (FR); Christian Quellet, Bienne (CH)

(73) Assignee: GIVAUDAN SA, Vernier (CH)

( * ) Notice: Subject to any disclaimer, the term of this patent is extended or adjusted under 35 U.S.C. 154(b) by 0 days.

(21) Appl. No.: 16/412,021

(22) Filed: May 14, 2019

(65) Prior Publication Data

US 2019/0264143 A1 Aug. 29, 2019

Related U.S. Application Data

(62) Division of application No. 15/312,414, filed as application No. PCT/EP2015/062983 on Jun. 10, 2015, now abandoned.

(30) Foreign Application Priority Data

Jun. 10, 2014 (EP) ..... 14290167

(51) Int. Cl.

| | |
|---|---|
| ***C11D 3/50*** | (2006.01) |
| ***C11D 3/22*** | (2006.01) |
| ***C11D 11/00*** | (2006.01) |
| ***C11D 17/00*** | (2006.01) |
| ***C11D 17/04*** | (2006.01) |
| ***C11D 17/06*** | (2006.01) |

(52) U.S. Cl.

CPC ..... *C11D 3/505* (2013.01); *C11D 3/222* (2013.01); *C11D 11/0023* (2013.01); *C11D 17/0039* (2013.01); *C11D 17/042* (2013.01); *C11D 17/06* (2013.01)

(58) Field of Classification Search

CPC ..... C11D 11/0023; C11D 17/0039; C11D 17/042; C11D 17/06; C11D 1/72; C11D 1/721; C11D 1/722; C11D 3/505; C11D 17/043

See application file for complete search history.

(56) References Cited

U.S. PATENT DOCUMENTS

| | | | | |
|---|---|---|---|---|
| 5,354,559 | A | 10/1994 | Morehouse | |
| 5,720,978 | A | 2/1998 | Morehouse | |
| 6,869,923 | B1 | 3/2005 | Cunningham et al. | |
| 2011/0152146 | A1 | 6/2011 | Denutte et al. | |
| 2013/0280409 | A1 | 10/2013 | Mushock et al. | |
| 2014/0170194 | A1* | 6/2014 | Cetti | A61Q 19/00 424/401 |
| 2016/0355756 | A1* | 12/2016 | Krasnansky | C11D 1/8255 |

FOREIGN PATENT DOCUMENTS

| | | | |
|---|---|---|---|
| EP | 0965326 | A1 | 12/1999 |
| JP | 2006045430 | A | 2/2006 |
| JP | 2009126885 | A | 6/2009 |
| JP | 2013518009 | A | 5/2013 |
| WO | 9419449 | A1 | 9/1994 |
| WO | 9734987 | A1 | 9/1997 |
| WO | 9927069 | A1 | 6/1999 |
| WO | 2011094470 | A1 | 8/2011 |

OTHER PUBLICATIONS https://sciencing.com/calculate-ppm-vapor-pressure-6457861.html Sep. 2019. (Year: 2019).*

* cited by examiner

*Primary Examiner* — John R Hardee
(74) *Attorney, Agent, or Firm* — Norris McLaughlin PA

(57) ABSTRACT

A dishwasher detergent composition comprising a starch-encapsulated fragrance composition, wherein the starch-encapsulated fragrance composition comprises one or more particles of starch-encapsulated fragrance composition.

18 Claims, No Drawings

DISHWASHER DETERGENT FRAGRANCE COMPOSITION

This is a divisional application of U.S. Pat. Application Ser. No. 15/312,412, filed Nov. 18, 2016, now abandoned.

The present invention is concerned with fragrance compositions useful in automatic dishwasher applications, and to dishwasher detergent compositions containing said fragrance compositions.

Many households have a dishwasher, and although dishwashers perform the work of washing the dishes often perceived by consumers as time-consuming and unpleasant work by hand, dishwashing using a dishwasher still has its disadvantages. Many consumers complain that the dishwashing process results in unpleasant smells, which escape once the dishwasher is opened after a dishwashing process. The presence of perfume provides an aesthetic benefit to the consumer upon use of a dishwasher, and generally serves as a signal of freshness and cleanliness. As a result there is a demand among consumers to pleasantly scent the air escaping from dishwashers.

Effectively incorporating fragrance ingredients to dishwashing detergent compositions is technically complex. A particular problem associated with dishwasher detergents is the relative harshness of detergent ingredients that must be employed because of the relative lack of mechanical cleaning action in automatic dishwashing machines. Dishwashing detergent products, and particularly the phosphate-reduced, or phosphate-free versions, contain high levels of harsh ingredients, such as bleach oxidizers and/or bleach activators, acidic builders, phosphonate chelating agents, which unfortunately, tend to degrade many sensitive perfume ingredients. Furthermore, the fluctuating temperature and humidity conditions found in an automatic dishwashing environment may result in the rapid dispersion, dilution and loss of fragrance ingredients to wash and rinse waters, such that when a dishwasher is opened the consumer does not experience the desired bloom of a pleasant fragrance. There remains, therefore, a need to improve the effectiveness of incorporating fragrance in and delivering fragrance from, a detergent composition in automatic dishwasher applications. In particular, there is a need to provide dishwasher fragrance compositions that protect fragrance ingredients from harsh dishwasher ingredients during storage, and which are able to retain fragrance ingredients in use under conditions of high and fluctuating temperature and humidity found in dishwashers in operation, and which is capable of delivering a bloom of fragrance at the end of a dishwashing cycle, without leaving any undesirable or lingering fragrance residue on absorbent washed articles.

The present invention addresses these needs and provides in a first aspect a dishwasher detergent composition comprising a starch-encapsulated fragrance composition.

The fragrance composition is encapsulated within a matrix of a water soluble, modified starch to form the starch encapsulated fragrance composition.

Starches suitable for encapsulating fragrance compositions are modified starches, which can be made from, raw starch, pre-gelatinized starch, modified starch derived from tubers, legumes, cereal and grains, for example corn starch, wheat starch, rice starch, waxy corn starch, oat starch, cassava starch, waxy barley, waxy rice starch, sweet rice starch, amioca, potato starch, tapioca starch and mixtures thereof.

Modified starches suitable for use as the encapsulating matrix in the present invention include starches that are modified chemically, physically, e.g. through heat or pressure, or enzymatically. They include hydrolyzed starch, acid thinned starch, starch esters of long chain hydrocarbons, starch acetates, starch octenyl succinate, and mixtures thereof.

Starch esters having a degree of substitution in the range of from about 0.01% to about 10.0% may be used to encapsulate the fragrance composition. The hydrocarbon part of the modifying ester should be from a C5 to C16 carbon chain.

The term "hydrolyzed starch" refers to oligosaccharide-type materials that are typically obtained by acid and/or enzymatic hydrolysis of starches, preferably corn starch. Suitable hydrolyzed starches for inclusion in the present invention include dextrins, for example those described in U.S. Pat. No. 3,455,838, and maltodextrins. The hydrolyzed starches may have a Dextrose Equivalent (DE) value of about 10 to about 36 DE. The DE value is a measure of the reducing equivalence of the hydrolyzed starch referenced to dextrose and expressed as a percent (on a dry basis). The higher the DE value, the more reducing sugars present. A method for determining DE values can be found in Standard Analytical Methods of the Member Companies of Corn Industries Research Foundation, 6th ed. Corn Refineries Association, Inc. Washington, D.C. 1980, D-52.

Whereas native starch is hydrophilic and is not particularly useful to encapsulate hydrophobic substances, which practically all fragrance ingredients are, it is necessary to use modified starches, such as the modified starches described above. Modified starches have emulsifying and emulsion-stabilizing capacity, and have the ability to entrap fragrance composition oil droplets in the form of oil-in-water emulsions due to the hydrophobic character of the starch modifying agent.

The emulsions can then be de-hydrated, for example by mechanical drying techniques such as spray drying, to form starch encapsulated fragrance compositions of the present invention in particulate form.

A range of commercially available starches are produced and include speciality modified starches such as Hi-Cap®, Capsul® and N-Lok® brands.

Modified starches as described herein bring numerous advantages including excellent emulsification and encapsulation performance; low viscosity, even at high solids content, thereby providing faster drying rates under mechanical drying with lower energy consumption; and low surface oil and excellent oxidation resistance to ensure good fragrance preservation and stabilization of sensitive ingredients.

Encapsulation of the fragrance composition reduces losses during storage and processing as it protects the fragrance ingredients against oxidation, hydrolysis, evaporation and incompatibilities with reactive substances contained in a dishwasher detergent composition.

Dishwasher detergent compositions may be presented in any conventional form, such as in the form of dry powders, dry powder unit doses, pouches, or as compressed dosage forms, such as tablets. Unit doses and tablets can furthermore have multiple compartments or layers comprising different compositions that are spatially separated for the sake of better stability or differentiated actions during the wash cycle.

If the starch-encapsulated fragrance compositions are intended to be incorporated into dishwasher detergent compositions in compressed form, the starch encapsulated fragrance composition particles should preferably possess the requisite mechanical properties to resist rupture, and concomitant loss of fragrance oil, in response to compressive forces experienced during a tableting process. In accordance with the present invention, in addition to the modified starch encapsulation materials referred to herein above, additional excipients may be employed in the encapsulated fragrance compositions to modify the mechanical properties of the particles.

Other matrix-forming materials include silicas, modified cellulose materials, such as ethylcellulose; and fructose, maltose, sucrose, lactose, inulin and glucose; as well as polymeric materials, such as block co-polymers, based on ethylene oxide and propylene oxide, such as the Pluronic® brand of materials.

Block co-polymer based on ethylene oxide and propylene oxide are particularly preferred when high perfume levels in the particles is desired. In particular, the applicant found that block co-polymers based on ethylene oxide and propylene oxide, such as the Pluronic® brand of materials surprisingly confer to the modified starch encapsulation material a higher resistance to pressure, leading to significantly reduced perfume exudation from the particles during tablet manufacturing, even at perfume loading higher than 25% by weight, and even up to 50% by weight, such as for example perfume loading of 32% by weight. Without being bound by theory, it may be envisioned that such block co-polymers help stabilizing the perfume oil droplet/modified starch matrix interface, whereas the ethylene oxide chains of the co-polymers plasticize the encapsulating matrix, making the latter less prone to crazing.

The fragrance ingredients employed in the formation of starch-encapsulated fragrance compositions form an essential component of the present invention. The physicochemical properties of the fragrance ingredients will influence the loading of the fragrance in the encapsulated fragrance composition; the extent to which the fragrance is stable in a dishwasher detergent composition; the physical stability of the dishwasher detergent compositions; the release profile of the fragrance during dishwasher operation; as well as the extent to which is fragrance leaves a residue, and provides an olfactive impression, on washed articles.

Starch-encapsulated fragrance compositions of the present invention contain fragrance ingredients that are typically very effusive and consumer noticeable, leaving minimal residual perfume on the washed items, including dishes, glasses and cutlery, especially those made of plastic, rubber and silicone.

Effusive fragrance ingredients of the type described above are often referred to in the art as blooming fragrance ingredients. Blooming fragrance ingredients can be formulated into automatic dishwashing detergent compositions and provide significantly better noticeability to the consumer than non-blooming fragrance compositions not containing a substantial amount of blooming fragrance ingredients.

However, dishwasher operations are carried out at relatively high temperatures, for example between about 50 to 75° C., and the proportion of blooming fragrance ingredients should not be so high as to risk the loss of significant amounts of fragrance material during the washing and rinsing cycles.

Some effusive/blooming fragrance ingredients should be present in the fragrance composition, e.g. at least about 1% by weight of the fragrance ingredients, to provide a pleasant and performant olfactive signal at the opening of the dishwasher, but not so much, to avoid substantial premature fragrance loss due to evaporation.

In a particular embodiment of the invention, no more than about 25%, still more particularly, no more than 20%, still more particularly, no more than 15%, and more particularly still, not more than about 10% by weight of the fragrance ingredients in the fragrance composition, have a vapour pressure of 4000 μg/l or greater, and more particularly 7000 μg/l or greater.

Examples of fragrance ingredients having a vapour pressure of 4000 μg/l or greater, and more particularly 7000 μg/l or greater include orange terpenes, ethyl, 2-methyl pentanoate, ethyl 2-methyl butyrate, hexyl acetate, methyl hexyl ketone, allyl caproate and ethyl oenanthate.

Particular compounds having a vapour pressure greater than 4000 mug/l include:-2-methyl propanoate, 2-methylpropyl acetate, ethyl butanoate, butyl acetate, ethyl 2-methylbutanoate, pent-4-enyl methyl ketone, hexanal, isopropyl 2-methylbutanoate, 2-methyl pyrazine, 2-methyl 3-furanthiol, alpha-pinene, 2-methylpropanyl 2-methyl propanoate, 2-methyl terahydrofuran-3-one, methyl hexanoate, amyl acetate, heptan-2-one, beta-pinene, heptanal, ethyl 2-methylpentanoate, 2,2,6-trimethyl-6-vinyltetrahydro-2H-pyran, 5-methyl-heptan-3-one, cis-hexen-3-yl formate, 3-methylbut-2-en-1-yl acetate, E-hex-2-enal, (1s,4s)-1,3,3-trimethyl-2-oxabicyclo[2.2.2]octane, 2-methyl-5-(prop-1-en-2-yl)-2-vinyltetrahydrofuran, 2-methyl-5-(methylthio)furan, 7-methyl-3-methyleneocta-1,6-diene, 4,5-dimethylthiazole, ethyl hexanoate, butyl butanoate, trimethylthiazol, thiophenol, (methoxymethyl)benzene, 1-methyl-4-(propan-2-ylidene)cyclohex-1-ene, cyclohexyl acetate, 3-methyl-but-2-en-1-ol, octan-3-one, 4-methylpent-4-en-2-yl, isobutyrate, p-cymene, cis-hex-3-enyl acetate, hexyl acetate, (E)-3,7-dimethylocta-1,3,6-triene, 3,5,5-trimethylhexanal, 1-methoxy-4-methylbenzene, 6-methylhept-5-en-2-one, 3-(methylthio)propanal, 1-methyl-4-(prop-1-en-2-yl)cyclohex-1-ene, octan-2-one, 5-methylfuran-2(3H)-one, cis-hexen-2-yl acetate, 1S,2S,4S)-2-methoxy-1,7,7-trimethylbicyclo[2.2.1]heptane, benzaldehyde, ethyl 3-methylhexanoate, (E)-5-(but-2-en-2-yl)-2,2-dimethyltetrahydrofuran, cis-hex-3-enol, 3-methylpentan-1-ol, gamma-terpinene, 2,6-dimethylhept-5-enal, 1,1-diethoxycyclohexane, ethyl 3-oxobutanoate, 2,4-dimethylcyclohex-3-enecarbaldehyde, pentyl butyrate, pentyl butyrate, ethyl heptanoate, (Z)-1-(1-ethoxyethoxy)hex-3-ene, 1-methoxyphenylethane, allyl hexanoate, cis-hex-3-enyl propionate, 1-vinylcyclohex-3-enecarbaldehyde, 4-vinylcyclohex-1-enecarbaldehyde, 4-methyl-2-(2-methylprop-1-en-1-yl)tetrahydro-2H-pyran.

Particular compounds having a vapour pressure greater than 7000 mug/l include:-

2-methyl propanoate, 2-methylpropyl acetate, ethyl butanoate, butyl acetate, ethyl 2-methylbutanoate, pent-4-enyl methyl ketone, hexanal, isopropyl 2-methylbutanoate, 2-methyl pyrazine, 2-methyl 3-furanthiol, alpha-pinene, 2-methylpropanyl 2-methyl propanoate, 2-methyl terahydrofuran-3-one, methyl hexanoate, amyl acetate, heptan-2-one, beta-pinene, heptanal, ethyl 2-methylpentanoate, 2,2,6-trimethyl-6-vinyltetrahydro-2H-pyran, 5-methyl-heptan-3-one, cis-hexen-3-yl formate, 3-methylbut-2-en-1-yl acetate, E-hex-2-enal, (1s,4s)-1,3,3-trimethyl-2-oxabicyclo[2.2.2]octane, 2-methyl-5-(prop-1-en-2-yl) -2-vinyltetrahydrofuran, 2-methyl-5-(methylthio)furan, 7-methyl-3-methyleneocta-1,6-diene, 4,5-dimethylthiazole, ethyl hexanoate, butyl butanoate, trimethylthiazol, thiophenol, (methoxymethyl)benzene, 1-methyl-4-(propan-2-ylidene)cyclohex-1-ene, cyclohexyl acetate, 3-methyl-but-2-en-1-ol, octan-3-one, 4-methylpent-4-en-2-yl, isobutyrate, p-cymene, cis-hex-3-enyl acetate, hexyl acetate, (E)-3,7-dimethylocta-1,3,6-triene, 3,5,5-trimethylhexanal, 1-methoxy-4-methylbenzene, 6-methylhept-5-en-2-one, 3-(methylthio) propanal, 1-methyl-4-(prop-1-en-2-yl)cyclohex-1-ene, octan-2-one.

Furthermore, in order that the fragrance ingredients may be encapsulated with high loading efficiency in the encapsulated fragrance composition, it is desirable if the fragrance ingredients have a solubility in water of less than 15'000 ppm, and still more particularly less than 10'000 ppm, at 25° C.

The starch encapsulated fragrance may also comprise ingredients that applicant found to be particularly chemically instable in tablets containing high level of bleach oxidizers and/or bleach activators, acidic builders, phosphonate chelating agents typically found in relatively high concentrations in phosphate-free or phosphate-reduced dishwasher detergent compositions.

Such fragrance ingredients include, but are not limited to cyclohexal; (E)-9-hydroxy-5,9-dimethyldec-4-enal; 3-(4-isobutyl-2-methylphenyl)propanal; 2-(2-(4-methylcyclohex-3-en-1-yl)allyl)cyclopentanone; 1-((1S,4R,8R)-1,8-dimethyl-2-oxabicyclo[2.2.2]octan-5-yl)ethanol; ((1S,4R,7S)-3,6,7-trimethyl-2-oxabicyclo[2.2.2]octan-5-yl)methanol; 9-hydroxy-5,9-dimethyldecanal; (S)-2-((2S,4aR)-1,1,5,5-tetramethyl-2,3,4,5,6,7-hexahydro-1H-2,4a-methanonaphthalen-8-yl)butan-1-ol; (R)-2-((2S,4a5,8aS)-1,1,5,5-tetramethyl-2,3,4,5,6,8a-hexahydro-1H-2,4a-methanonaphthalen-8-yl)butan-1-ol; (3aR,5aS,8S,9aR,9bS)-2,2,3a,5,5,9,9-heptamethyloctahydro-3aH-5a,8-methanonaphtho[1,2-d][1,3]dioxole; (1-methyl-2-(5-methylhex-4-en-2-yl)cyclopropyl)methanol; (E)-7-(4-methylpent-1-en-1-yl)-2H-benzo[b][1,4]dioxepin-3(4H)-one; 4-(4-hydroxy-4-methylpentyl)cyclohex-3-enecarbaldehyde; 3-(4-(tert-butyl)phenyl)-2-methylpropanal; (E)-4-((3a5,7aS)-hexahydro-1H-4,7-methanoinden-5(6H)-ylidene)butanal; 3-(3-isopropylphenyl)butanal; 3-(4-(tert-butyl)phenyl)propanal; 3-(4-isobutylphenyl)-2-methylpropanal; 3-(4-methoxyphenyl)-2-methylpropanal; 1-methyl-4-(4-methylpentyl)cyclohex-3-enecarbaldehyde; (E)-dodec-2-enal; 2,6,10-trimethylundec-9-enal; benzo[d][1,3]dioxole-5-carbaldehyde; 5-pentyldihydrofuran-2(3H)-one; 5-heptyldihydrofuran-2(3H)-one; 2-cyclohexylhepta-1,6-dien-3-one; 7-isopentyl-2H-benzo[b][1,4]dioxepin-3(4H)-one; octahydro-2H-chromen-2-one; methyl 2-(3-oxo-2-pentylcyclopentyl) acetate; 2-(2-(4-methylcyclohex-3-en-1-yl)propyl) cyclopentanone; 2-(tert-butyl)cyclohexyl acetate; 3,7-dimethylocta-1,6-dien-3-yl formate; 2-methyl-6-methyleneoct-7-en-2-yl acetate; 2-ethyl-N-methyl-N-(m-tolyl)butanamide; (E)-6,10-dimethylundeca-5,9-dien-2-yl acetate; 6,8-Nonadien-3-one, 2,4,4,7-tetramethyl-, oxime; 2-(2-mercaptopropan-2-yl)-5-methylcyclohexanone; (4S)-4,7,7-trimethyl-6-thiabicyclo[3.2.1]octane; 2-methyl-4-propyl-1,3-oxathiane; (4-methyl-4-phenylpentan-2-yl) acetate; mercapto para-menthadiene; (E)-3,7-dimethylocta-2,6-diene-1-thiol; 5-methyl-2-propan-2-ylcyclohexan-1-one; (E)-5-methylheptan-3-one oxime; undecanal; decanal; dodecanal; 2-methylundecanal; tridecanal; (E)-undec-9-enal; (Z)-2-benzylideneheptanal; pentyl 2-hydroxybenzoate; ethyl 2-hydroxybenzoate; benzyl 2-hydroxybenzoate; (Z)-hex-3-en-1-yl 2-hydroxybenzoate; 3-(4-isopropylphenyl)-2-methylpropanal; cyclohexyl 2-hydroxybenzoate; 8,8-dimethyl-1,2,3,4,5,6,7,8-octahydronaphthalene-2-carbaldehyde; 6-pentyltetrahydro-2H-pyran-2-one; 6-hexyltetrahydro-2H-pyran-2-one; 6-heptyltetrahydro-2H-pyran-2-one; 6-propytetrahydro-2H-pyran-2-one; 6-propytetrahydro-2H-pyran-2-one; 5-octyldihydrofuran-2(3H)-one; (E)-dec-2-enal; (E)-dec-4-enal; decanal; 6-heptyltetrahydro-2H-pyran-2-one; 5-octyldihydrofuran-2(3H)-one; (E)-dodec-2-enal; hexyl 2-hydroxybenzoate; 5-Methyl-7-(1-methylethyl)bicyclo[2.2.2]oct-5-ene-2-carboxaldehyde; (2E,6Z)-nona-2,6-dienal; (2E,6Z)-nona-2,6-dien-1-ol; (Z)-non-6-enal; 6-propyltetrahydro-2H-pyran-2-one; 5-butyldihydrofuran-2(3H)-one; (3aR,6S,7aS)-3a,4,5,6,7,7a-hexahydro-1H-4,7-methanoinden-6-yl propionate; (3aR,6S,7aS)-3a,4,5,6,7,7a-hexahydro-1H-4,7-methanoinden-6-yl isobutyrate; (3aR,6S,7aS)-3a,4,5,6,7,7a-hexahydro-1H-4,7-methanoinden-6-yl acetate; (3aS,4S,7R,7aS)-ethyl octahydro-1H-4,7-methanoindene-3a-carboxylate; 5-pentyldihydrofuran-2(3H)-one; 5-heptyldihydrofuran-2(3H)-one; 1-(3-methylbenzofuran-2-yl)ethanone; and 2-ethoxynaphthalene.

Having regard to the foregoing limitations, any fragrance ingredient is suitable for use in the starch encapsulated fragrance compositions of the present invention. They include a wide variety of natural and synthetic ingredients, including, but not limited to, aldehydes, ketones, esters, and the like. Also included are various natural extracts and essences which can comprise complex mixtures of ingredients, such as orange oil, lemon oil, eucalyptus, lavender, patchouli, pine oil, cedar, and the like. They can be employed as discreet ingredients, but more often they are more or less complex mixtures of ingredients of natural or synthetic origin. The nature of these ingredients can be found in specialised books of perfumery, e.g. in S. Arctander (Perfume and Flavor Chemicals, Montclair N.J., USA 1969). Specific ingredients include (2S,4S)-1,7,7-trimethylbicyclo[2.2.1]heptan-2-yl acetate; 2,6-dimethyloct-7-en-2-ol; 2,6-dimethylheptan-2-ol; (2E,6Z)-3,7-dimethylnona-2,6-dienenitrile; 2-(tert-butyl)cyclohexyl acetate; 3,7-dimethylocta-1,6-dien-3-ol; 3,7-dimethyloct-6-en-1-ol; 1-methyl-4-(propan-2-ylidene)cyclohex-1-ene; (3aR,6S,7aS)-3a,4,5,6,7,7a-hexahydro-1H-4,7-methanoinden-6-yl acetate; 2-methylundecanal; 5-pentyldihydrofuran-2(3H)-one; (1s,4s)-1,3,3-trimethyl-2-oxabicyclo[2.2.2]octane; 2-(sec-butyl)cyclohexanone; 5-heptyldihydrofuran-2(3H)-one; (E)-2-benzylideneoctanal.

Typically, the total amount of fragrance employed will be around 0.05 to about 0.5% by weight based on the weight of the finished dishwasher detergent composition.

By selecting the encapsulating medium and the fragrance ingredients for the starch-encapsulated fragrance composition according to the manner described herein above, the applicant found that it was possible to encapsulate the fragrance ingredients with very high encapsulation efficiency. In particular, it was possible to reach fragrance loading of up to about 50% Furthermore, encapsulated fragrance compositions exhibited low fragrance leakage, even after application of mechanical compression forces associated with formation of a tablet. In particular, applicant found that it was possible to limit mechanically induced fragrance exudation to levels of less than 25%, and more particularly less than 20%.

Encapsulated fragrance compositions of the present invention may be formed by techniques generally known in the art.

In a typical process suitable for the manufacture of a starch encapsulated fragrance composition of the present invention, a modified starch, such as CAPSUL® E (National Starch & Chemical) would be added to water with stirring to form a solution. Thereafter, the fragrance composition would be added under continued agitation. A typical agitation speed would be around 600 to 700 rpm. Agitation would continue until the desired droplet size was obtained. In accordance with the present invention, starch-encapsulated fragrance compositions can be prepared having a volume weighted particle size of about 10 to about 120 micrometres. Droplets of fragrance oil embedded in said particles, may have a volume weighted particle size of 0.1 to 2 micrometers with a median D50 smaller than 1 micrometer. Thereafter, the emulsion would be pumped into a spray drying apparatus and atomized through a nozzle or spinning disk with a co-current air flow for drying. A typical inlet temperature might be set at around 200° C., and an outlet temperature of around 100° C. Dry particles of encapsulated fragrance composition would then be collected at the dryer outlet.

In addition to encapsulated fragrance oil, it is possible to employ free fragrance oil. Owing to the harsh environment, the free oil fragrance ingredients should be sufficiently stable to withstand this. Fragrance ingredients useful in a free oil component, include but are not limited to alcohols, such as 3,7-dimethyloct-6-en-1-ol; (Z)-hex-3-en-1-ol; (1-methyl-2-((1,2,2-trimethylbicyclo[3.1.0]hexan-3-yl) methyl)cyclopropyl)methanol; (1S,2S,4S)-1,7,7-trimethylbicyclo[2.2.1]heptan-2-ol; (1S,2R,4R)-1,3,3-trimethylbicyclo[2.2.1]heptan-2-ol; (E)-4-methyldec-3-en-5-ol; 3-isobutyl-1-methylcyclohexanol; 2,6-dimethyloct-7-en-2-ol; 3,7-dimethylocta-1,6-dien-3-ol; and 2-(4-methylcyclohex-3-en-1-yl)propan-2-ol.

Encapsulated fragrance compositions of the present invention may be used to provide scent to any automatic dishwasher detergent compositions known in the art.

The major components in automatic dishwashing detergents are alkaline silicates and builders. The most common builder systems contained phosphates (tripolyphosphate), but more recently new compositions have been introduced, which reduce or eliminate phosphates and replace them with non-phosphate complexing agents.

During washing, the alkaline environment and the high temperatures (up to about 75° C.) remove fatty and oily soils via alkaline hydrolysis; coloured stains can be removed by oxidation with a bleach system; starch and protein can be removed hydrolytically using enzymes; and surfactant, which should be low-foaming act as wetting agents. Other components may include preservatives, dyes, solvents, fillers, corrosion inhibitors as well as perfumes.

Modern consumers can purchase multi-functional dishwasher detergent compositions, in the form of powders, unit doses, tablets or pouches, which contain some or all of the aforementioned components.

In an embodiment of the present invention, the dishwasher detergent composition contains a builder, which may be a phosphate builder, such tripolyphosphates, hexametaphosphate, orthophosphate, and the alkali metal salts thereof. However, it is preferred if the dishwasher detergent composition is a reduced-phosphate, or phosphate-free composition. Suitable replacement builders include amino polycarboxylic compounds. These compounds can act as builders, and bind ions like magnesium and calcium. In particular, the amino polycarboxylic compound may be selected from methylglycine diacetic acid (MGDA) and iminodiacetic acid (IDS). The most preferred type of amino polycarboxylic compound is MGDA. Optionally the composition comprises further builders, which may be selected for example from the group comprising alkali metal carbonates, bicarbonates, borates, zeolites and mixtures thereof.

In compositions of the present invention, the amount of amino polycarboxylic compound, preferably MGDA, is at least 25 wt %, and is preferably between 25 and 70 wt % of the total dishwasher detergent composition, more preferred between 25 and 60 wt %, and most preferred between 30 and 45 wt %.

The form in which the MGDA and/or IDS and/or their salts can be applied in the compositions can be any, and for this invention is preferably the form of a powder or a granule.

Alternative builder systems are described in US2010/0144576, incorporated herein by reference.

The dishwasher detergent composition may contain a bleach system. Bleach systems can be categorized as oxygen bleaches and chlorine bleaches.

Oxygen bleaches include alkali metal perborates and their hydrates, and also alkali metal percarbonates. Preferred bleaches in this context are sodium perborate in the form of the mono- or tetrahydrate, sodium percarbonate or the hydrates of sodium percarbonate. Oxygen bleaches also include persulphates and hydrogen peroxide, as well as oxygen peracids, for example perbenzoic acid, peroxy-alpha-naphthoic acid, peroxylauric acid, peroxystearic acid, phthalimidoperoxycaproic acid, 1,12-diperoxydodecane-dioic acid, 1,9-diperoxyazelaic acid, diperoxoisophthalic acid or 2-decyl-diperoxybutane-1,4-dioic acid.

Oxygen bleaches may be used in amounts of generally 0.5 to 30% by weight based on the total dishwashing detergent composition.

Chlorine bleaches include, but are not limited to, 1,3-dichloro-5,5-dimethylhydantoin, N-chloro-sulphamide, chloramine T, dichloramine T, chloramine B, N,N'-dichlorobenzoylurea, p-toluene-sulphonyldichloramide or trichloroethyleneamine. Preferred chlorine bleaches are sodium hypochlorite, calcium hypochlorite, potassium hypochlorite, magnesium hypochlorite, potassium dichloroisocyanurate or sodium dichloroisocyanurate.

Chlorine bleaches may be used in amounts of generally 0.1 to 20% by weight based on the total dishwashing detergent formulation.

In addition, it is possible to add small amounts of bleach stabilizers, for example phosphonates, borates, metaborates, metasilicates or magnesium salts.

A dishwasher composition according to the present invention may contain an alkaline silicate material. Silicates may be employed in amounts up to 30% by weight based on the weight of the detergent composition. These materials, as is known in the art, prevent fading of colours on glaze porcelain and decorated glasses via corrosion, as well as on enamel and metal corrosion.

Preferred silicates are selected from alkali metasilicates or alkali metal silicates, particularly potassium and sodium silicates.

One or more nonionic surfactants may be present in the dishwasher detergent compositions of the present invention. The compositions may contain a total amount of nonionic surfactants in the compositions of up to 10% by weight, based on the total weight of the detergent composition.

Nonionic surfactants may include any alkoxylated nonionic surface-active agent wherein the alkoxy moiety is selected from the group consisting of ethylene oxide, propylene oxide, butylene oxide, and mixtures thereof. The nonionic surfactants are preferably used to improve the detergency and to suppress excessive foaming due to protein soil. Examples of suitable nonionic surfactants are low- to non-foaming ethoxylated and/or propoxylated straight chain fatty alcohols.

In addition to nonionic surfactants, the compositions may comprise anionic surfactants. If present, the total amount thereof should be at levels of less than 5% by weight based on the total weight of the detergent composition.

Furthermore, if any anionic surfactant is present, it is preferred that an antifoam agent to suppress foaming is present, for example paraffin oil or silicone oil.

The dishwasher detergent composition of the present invention may comprise a water soluble salt of bismuth. Bismuth salts may be employed for the purpose of preventing visible glass corrosion and decor fading. The level of water soluble bismuth salt in the dishwasher detergent composition of the invention is preferably less than about 3% by weight, based on the total weight of the detergent composition.

Water soluble bismuth salts suitable include bismuth acetate, acetate dihydrate, bromide, butyrate, citrate, citrate dihydrate, chloride, iodide, iodide dihydrate, caproate, formate, formate dihydrate, fumarate, gluconate, glycinate, lactate, malate, maleate, nitrate, nitrate trihydrate, nitrate hexahydrate, phenolsulphonate, sulphate monohydrate, sulphate heptahydrate, sulphate hexahydrate, salicylate, succinate, tartrate, valerate, saccharinate, and carboxymethyl oxysuccinate.

The dishwasher detergent composition of the present invention may comprise an anti-spotting agents and/or anti-scaling agents.

Examples of suitable anti-spotting agents include hydrophobically modified polyacrylates, whereas also synthetic clays, and preferably those synthetic clays which have a high surface area are very useful to prevent spots, in particular those formed where soil and dispersed remnants are present at places where the water collects on the glass and spots formed when the water subsequently evaporates. Antispotting systems such as hydrophobically modified polyacrylates are advantageous in the so-called multifunctional systems.

Examples of suitable anti-scaling agents include organic phosphonates, amino carboxylates, polyfunctionally-substituted compounds, and mixtures thereof. Particularly preferred anti-scaling agents are organic phosphonates such as [alpha]-hydroxy-2-phenyl ethyl diphosphonate, ethylene diphosphonate, hydroxy-1, 1-hexylidene, vinylidene 1,1-diphosphonate, 1, 2-dihydroxyethane-I, 1-diphosphonate and hydroxy-ethylene-1, 1-diphosphonate . Most preferred is hydroxy-ethylene-1, 1-diphosphonate (EDHP) and 2-phosphono-butane-I, 2, 4-tricarboxylic acid.

If present, these materials may each be present in amounts up to 15% by weight based on the total weight of the detergent composition.

Enzymes may be present in the detergent composition of the present invention. Examples of enzymes suitable for use in this invention include lipases, peptidases, amylases (amylolytic enzymes) and others which degrade, alter or facilitate the degradation or alteration of biochemical soils and stains encountered in cleansing situations so as to remove more easily the soil or stain from the object being washed to make the soil or stain more removable in a subsequent cleansing step. Both degradation and alteration can improve soil removal. Preferably, the composition of the invention also contains a proteolytic enzyme. Enzymes may be present in an amount of about 0.2 to 7% by weight based on the total weight of the detergent composition.

Optional ingredients for use in detergent compositions according to the invention include, buffering agents, reducing agents, e.g., borates, alkali metal hydroxide and the well-known enzyme stabilisers such as the polyalcohols, e.g. glycerol and borax, crystal-growth inhibitors, threshold agents, dyestuffs and the like. In tablets binding agents can be used e.g. modified starches.

Reducing agents may be used, e.g., to prevent the appearance of an enzyme-deactivating concentration of oxidant bleach compound. Suitable agents include reducing sulphuroxy acids and salts thereof. Most preferred for reasons of availability, low cost, and high performance are the alkali metal and ammonium salts of sulphuroxy acids including ammonium sulphite, sodium sulphite, sodium bisulphite, sodium metabisulphite, potassium metabisulphite, lithium hydrosulphite, etc., sodium sulphite being particularly preferred. Another useful reducing agent, though not particularly preferred for reasons of cost, is ascorbic acid.

The detergent composition according to the invention may comprise a rinse aid composition/ingredient. Rinse aid ingredients are ingredients that affect the final appearance of the table ware that is washed.

Suitable forms for the machine dishwasher detergent composition are powders and tablets and mixtures thereof. Preferably the compositions are unit dose compositions such as tablets. Unit dose compositions such as tablets may be wrapped in a water soluble wrap for easy handling. In the context of this specification, a tablet is understood to be a compressed particulate composition that can be considered to be a solid shaped body.

In a preferred embodiment the detergent tablets of the present invention can be monophase tablets, as well as multiphase tablets. These phases may have a different colour and each phase may comprise different ingredients, which may be active in the sequential steps of washing. The phases of the multiphase detergent tablet are preferably separate layers within the tablet. However, a discrete region of a tablet could also have any other form, for example one or more cores, or inserts, in the form of a sphere.

The tablets may be of any shape. However, for ease of packaging they are preferably blocks of substantially uniform cross-section, such as cylinders or cuboids. In general the upper and lower surfaces of the tablet are substantially flat. The overall density of a tablet preferably lies in a range from 1000 up to 1700 g/L.

Preferably the phases of the preferred tablet together have a weight of 5 to 70 gram, more preferred 10 to 40 gram. The weight of the tablets depends on the conditions of intended use, and whether it represents a dose for an average load in a dishwashing machine or a fractional part of such a dose. As indicated earlier in this specification, machine dishwash detergent compositions according to the invention may suitably be dosed in the wash liquour at levels of from 2 g/l to 10 g/l.

EXAMPLES

The following non-limiting examples further illustrate the present invention.

Example 1

Two dish wash tablets comprising encapsulated perfumes P1 and P2 were evaluated in use against tablets comprising the same dish wash base and perfumes P1 and P2 as free oil. The evaluation was performed on fresh samples, i.e. directly after tableting, and on aged samples, i.e. after one month storage at 40° C. The encapsulated perfumes were evaluated at a dosage of 0.8% by weight the tablets and the free perfume oils were evaluated 0.13% by weight in the tablet. The perfume intensity was assessed on opening the door of the dish wash machine after wash cycle completion, according to an intensity scale (0=odourless; 5=powerful). The results are reported in Table 2.

TABLE 2

| | Fresh sample encapsulated oil | Fresh sample free oil | Aged sample encapsulated oil | Aged sample free oil |
|---|---|---|---|---|
| Perfume P1 | 4 | 3.5 | 4 | 2 |
| Perfume P2 | 4 | 3.5 | 3.5 | 1 |

The results confirm the benefit of perfume encapsulation after aging the samples at 40° C. for one month.

Example 2

A series of spray dried powders containing various levels of fragrance oil and various encapsulating matrix compositions have been prepared by spraying fragrance oil in water emulsions having 50% by weight water. The emulsions were prepared by dispersing the fragrance oil in an aqueous phase comprising the encapsulating materials, including the emulsifier. The emulsion was sprayed at 73 ml/min. The inlet temperature was 180° C. and the outlet temperature was 80° C. The dried powder was then admixed with a commercial dish washing powder and the mixture was tableted at a pressure of 20'000 Newton, using a conventional tableting machine. The level of fragrance that was exuded from the spray dried particles following the application of the tableting pressure was determined by extracting part of the tablet material with methyl t-butyl ether followed by quantitative GC analysis. Under such extraction conditions, only the free perfume oil in the tablet is measured.

The remaining tablet was stored for one month at room temperature and then for one month at 37° C. and 70% relative humidity in a climatic cupboard. The tablet material was then extracted with a mixture of methanol and water (75:25) in an ultra-sonic bath. The extract was cleaned by passing it through an adsorbent cartridge (EXTRELUT), followed by quantitative GC analysis. Under such extraction conditions, the total (free and encapsulated) fragrance is measured.

TABLE 1

| | Sample | | | | |
|---|---|---|---|---|---|
| | A | B | C | D | E |
| Glucidex ® maltodextrin 6 (DE = 6) (ex ROQUETTE) | 60 | 23 | 53.9 | 49.8 | 0 |
| Capsul ® E 1450 (ex NATIONAL STARCH) | 15 | 12 | 11.5 | 12.4 | 0 |
| Pluronic ® PE 6100 (ex BASF) | 0 | 0 | 8.6 | 7.8 | 0 |
| Glucose (conventional sugar) | 0 | 40 | 0 | 0 | 0 |
| Perfume | 25 | 25 | 25 | 32 | 100 |
| Exuded free oil after tableting (wt % of initial oil content) | 34 | 22 | 14 | 22 | 96 |
| Total perfume oil remaining in the tablet after storage | 63 | 51 | 72 | 53 | 20 |

Examples C and D illustrate the benefit of using block co-polymers based on ethylene oxide and propylene oxide in spray dried powder intended for use in tablets. Example A is added as a comparative example with only maltodextrin and modified starch. Example B is added as comparative example illustrating the benefit of glucose during tableting, but its deleterious effect on stability. Example E shows that without encapsulation, the perfume used in the study, which was deliberately chosen as chemically unstable for the sake of the demonstration, was significantly lost, due to evaporation and chemical degradation.

The invention claimed is:

1. A dishwasher detergent composition comprising a starch-encapsulated fragrance composition, wherein the fragrance composition is encapsulated within a matrix of a water soluble, modified starch to form the starch-encapsulated fragrance composition, wherein the starch-encapsulated fragrance composition comprises a copolymer of ethylene oxide and propylene oxide.

2. A dishwasher composition according to claim 1, which is substantially phosphate-free.

3. A dishwasher detergent composition according to claim 1, wherein the starch-encapsulated fragrance composition comprises one or more particles of starch-encapsulated fragrance composition.

4. A dishwasher detergent composition according to claim 1, wherein the starch-encapsulated fragrance composition comprises starch octenyl succinate.

5. A dishwasher detergent composition according to claim 1, wherein the starch-encapsulated fragrance composition comprises a maltodextrin.

6. A dishwasher detergent composition according to claim 1, wherein the fragrance composition comprises no more than 25%, by weight of the fragrance ingredients in the fragrance composition, have a vapour pressure of 4000 μg/l or greater.

7. A dishwasher detergent composition according to claim 1, wherein the fragrance composition comprises fragrance ingredients having a solubility in water of less than 15,000 ppm.

8. A dishwasher detergent composition according to claim 7, wherein the fragrance composition comprises no more than 20% by weight of the fragrance ingredients in the fragrance composition, have a vapour pressure of 4000 μg/l or greater.

9. A dishwasher detergent composition according to claim 8, wherein the fragrance composition comprises no more than 15% by weight of the fragrance ingredients in the fragrance composition, have a vapour pressure of 4000 μg/l or greater.

10. A dishwasher detergent composition according to claim 9, wherein the fragrance composition comprises no more than 10% by weight of the fragrance ingredients in the fragrance composition, have a vapour pressure of 4000 μg/l or greater.

11. A dishwasher detergent composition according to claim 7, wherein the fragrance composition comprises no more than 25% by weight of the fragrance ingredients in the fragrance composition, have a vapour pressure of 7000 μg/l or greater.

12. A dishwasher detergent composition according to claim 11, wherein the fragrance composition comprises no more than 20% by weight of the fragrance ingredients in the fragrance composition, have a vapour pressure of 7000 μg/l or greater.

13. A dishwasher detergent composition according to claim 12, wherein the fragrance composition comprises no more than 15% by weight of the fragrance ingredients in the fragrance composition, have a vapour pressure of 7000 μg/l or greater.

14. A dishwasher detergent composition according to claim 13, wherein the fragrance composition comprises no more than 10% by weight of the fragrance ingredients in the fragrance composition, have a vapour pressure of 7000 μg/l or greater.

15. A dishwasher detergent composition according to claim 1, in the form of a particulate composition.

16. A dishwasher detergent composition according to claim 1, in a unit dose or pouch form.

17. A dishwasher detergent composition according to claim 16, where the composition is in a compressed particulate form.

18. A dishwasher composition according to claim 1, wherein the composition is wrapped in a water soluble material.

* * * * *